United States Patent [19]

Hill et al.

[11] 4,262,418

[45] Apr. 21, 1981

[54] BOOT FOR TRIMMER FOR RESILIENT FLOOR COVERING MATERIAL

[75] Inventors: Harvey J. Hill, Monterey Park; Wolfgang Spiegelstein, Glendale, both of Calif.

[73] Assignee: Roberts Consolidated Industries, Inc., City of Industry, Calif.

[21] Appl. No.: 67,778

[22] Filed: Aug. 20, 1979

[51] Int. Cl.[3] ..... B26B 29/00

[52] U.S. Cl. ..... 30/287; 30/294

[58] Field of Search ..... 30/294, 293, 287

[56] References Cited

U.S. PATENT DOCUMENTS

| | | | |
|---|---|---|---|
| 2,743,523 | 5/1956 | Haney | 30/294 X |
| 3,167,861 | 2/1965 | Knebel | 30/294 |
| 3,395,453 | 8/1968 | Prater | 30/294 X |
| 3,605,267 | 9/1971 | Brenner | 30/293 X |
| 3,934,341 | 1/1976 | Carlson | 30/294 X |
| 3,991,467 | 11/1976 | Yokoyama | 30/294 X |
| 4,130,939 | 12/1978 | Toal | 30/294 X |

*Primary Examiner*—Frank T. Yost

[57] ABSTRACT

A low-friction boot for a floor-covering trimmer having a base provided at the rear thereof with an upwardly extending handle and carrying at the front thereof at least one forwardly and downwardly extending blade. The boot is of a size and shape to completely cover the bottom of the base and is equipped with attachment means engageable with the base. The boot is also provided at the front thereof with an opening for the blade. At the front, rear and ends of the boot are upstanding walls which cover the front, rear and ends of the base of the trimmer. With such a boot, friction is minimized when trimming linoleum-like floor coverings in particular, and scratching or otherwise marring such coverings is prevented.

6 Claims, 8 Drawing Figures

BOOT FOR TRIMMER FOR RESILIENT FLOOR COVERING MATERIAL

BACKGROUND OF INVENTION

The present invention relates in general to floor-covering trimmers, such as that shown in U.S. Pat. No. 3,395,453, granted Aug. 6, 1968 to Earle F. Prater, and, more particularly, to a boot for installation on the bottom of the base of such a trimmer. The trimmer includes two basic components , viz., a handle and base unit and a blade-carrying attachment detachably mounted on the handle and base unit. The attachment carries at the front thereof at least one forwardly and downwardly extending blade, there frequently being two such blades in forwardly and downwardly diverging relation to enable selective use of such blades for cutting in opposite directions.

Other prior art of some relevance includes the following U.S. Pat. Nos.:

Benson, 3,133,350
Smith, 3,574,939
Kelley et al, 3,844,038
Harian, 2,966,742

The patents in the foregoing list are pertinent only in that they disclose the use of rollers, or the like, for facilitating movement of devices similar, or analogous to, carpet trimmers.

OBJECTS AND SUMMARY OF INVENTION

The basic object of the invention is to provide a trimmer boot which performs such functions as reducing friction when the trimmer is used on linoleum floor coverings, or the like, and which prevents scratching or marring of such floorings.

More particularly, the invention may be summarized as comprising, and a primary object of the invention is to provide, a boot of a size and shape to completely cover the bottom of the base of the trimmer and having means for attachment to the base, the boot having at the front thereof an opening or openings for the trimmer blade or blades.

Other objects are to provide a boot having at the front rear and ends thereof upstanding walls which cover the front, rear and ends of the base, and to provide attachment means for connecting the boot to the base comprising hook means at the front of the boot adapted to hook over the front of the base and hook means at the rear of the boot adapted to snap and hook over the rear of the base. Still other objects are to provide attachment means, for engagement with the base, at the end walls of the boot, on the bottom of the boot, or the like.

Another important object is to make the boot of a material which minimizes sliding friction when the trimmer is moved over a floor covering, and particularly a floor covering of the linoleum type, in trimming same. Examples of a suitable material for the boot serving this function are polyethylene, Teflon, a combination of the two, or the like.

The foregoing objects, advantages, features and results of the present invention, together with various other objects, advantages, features and results which will be evident to those skilled in the trimmer art in the light of this disclosure, may be achieved with the exemplary embodiment of the invention illustrated in the accompanying drawing and described in detail hereinafter.

DETAILED DESCRIPTION OF EXEMPLARY EMBODIMENTS OF INVENTION

Figure 1:
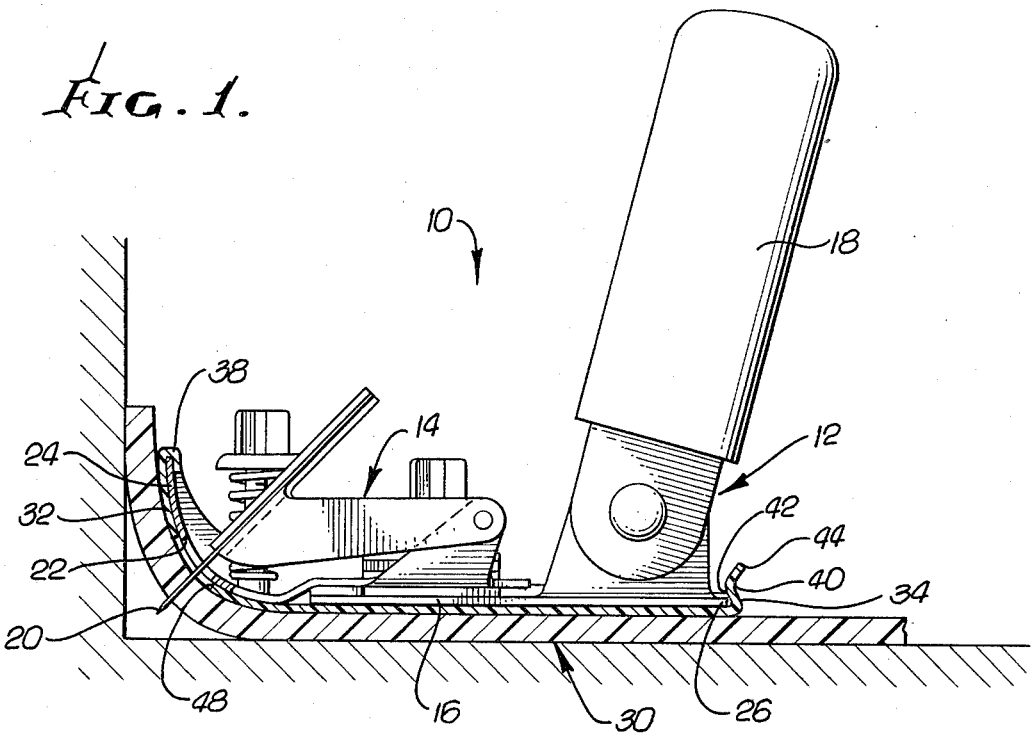
FIG. 1 is a view, partially in end or side elevation and partially in section, showing a boot of the invention installed on a trimmer similar to that shown in the aforementioned Prater patent.
Figure 2:
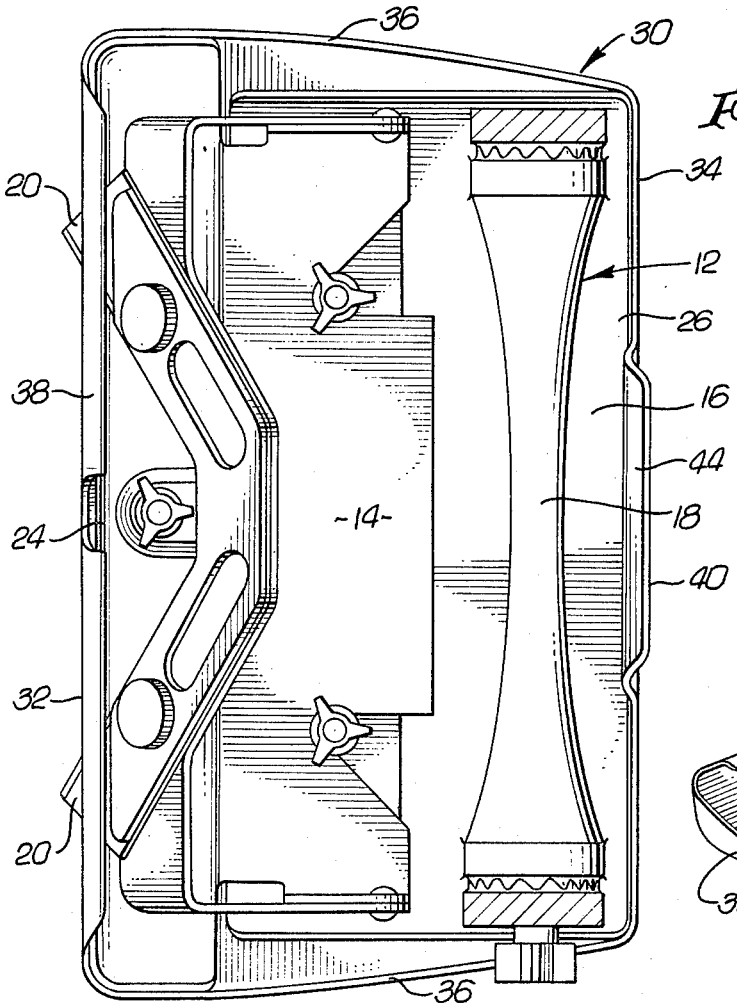
FIG. 2 is a plan view of the trimmer with the boot of FIG. 1 thereon.

The trimmer illustrated in FIGS. 1 and 2 of the drawings is designated generally by the numeral 10 and includes two basic components, viz., a handle and base unit 12 and a blade carrying attachment 14 detachably mounted on the handle and base unit. These components are disclosed in detail in the Prater patent mentioned, and will be described only briefly herein.

The handle and base unit 12 comprises a base 16 and a handle 18. The attachment 14 carries at the front thereof two blades 20 in forwardly and downwardly diverging relation to enable selective use of such blades for cutting in opposite directions. The blades 20 project forwardly and downwardly through openings 22 in what is effectively an upturned forward extension 24 at the front of the base 16. The latter has a rear edge 26 paralleling and spaced rearwardly from the front extension 24.

The boot of the invention, as shown in FIGS. 1 and 2, is designated generally by the numeral 30 and is of a size and shape to completely cover the bottom of the trimmer 10. The boot has at the front and rear thereof upstanding walls 32 and 34 respectively covering the front and rear 24 and 26 of the base 16, and is provided at the ends or sides thereof with upstanding end or side walls 36 respectively covering the ends or sides of the trimmer base. Thus, the bottom of the trimmer 10 is completely enclosed by the boot 30.

The boot 30 is provided with means at the front and rear thereof for attachment to the front and rear 24 and 26 of the trimmer base. The front attachment means is designated generally by the numeral 38 and simply comprises hook means adapted to hook over the upturned base front 24, as best shown in FIG. 1. The rear attachment means is designated by the numeral 40 and may also comprise hook means engageable with the rear edge 26 of the base, having a downwardly facing shoulder 42 adapted to engage the upper side of the base rear edge 26, as shown in FIG. 1. The rear attachment means 40 also includes a thumb tab 44 for releasing the boot 30.

Figure 3:
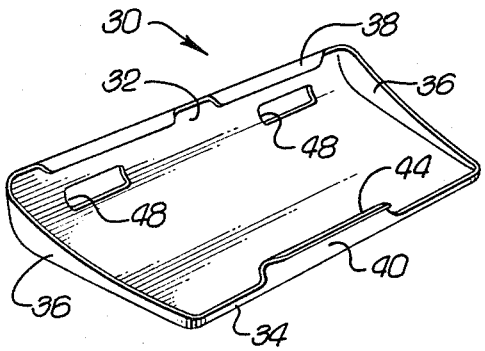
FIG. 3 is a perspective view on a reduced scale of the boot of FIGS. 1 and 2.

The upstanding front wall 32 of the boot 30 is provided with openings 48 through which the blades 20 extend. (See also FIG. 3.)

With the boot 30 installed on the trimmer 10 in the manner illustrated and described, the trimmer may be used for trimming any desired floor covering, such as carpeting, or floor coverings of what may be referred to as the linoleum type. The boot 30 is made of a low-friction material to minimize frictional resistance to movement of the trimmer 10 with the boot thereon, particularly in connection with linoleum-like floor coverings. Further, the boot 30 eliminates scratching or otherwise marring linoleum-like floor coverings, which is an important feature. Examples of a suitable material for the boot serving such functions are polyethylene, Teflon, a combination of the two, or the like.

Figure 4:
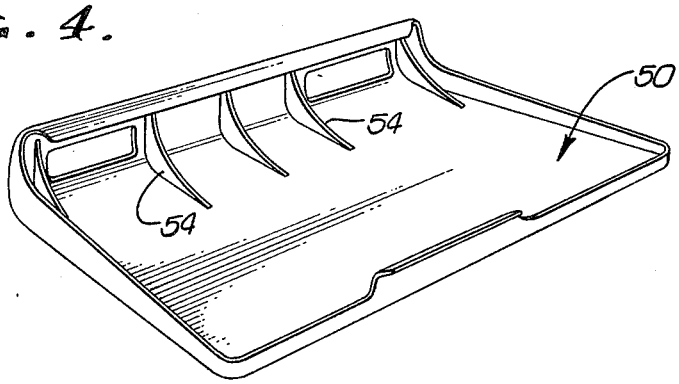
FIG. 4 is a perspective view of still another boot embodiment.
Figure 5:
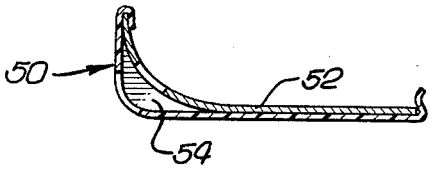
FIG. 5 is sectional views of the FIG. 4 embodiment.

FIGS. 4 and 5 show an alternative boot 50, on a trimmer base 52 in FIG. 5, having laterally spaced reinforcing ribs 54 at the front thereof. As will be clear from FIG. 5, the ribs 54 space the front of the boot 50 forwardly from the base 52. This structure is useful when cutting soft flexible materials, for more accuracy and more economy (less material cut off).

Figure 6:
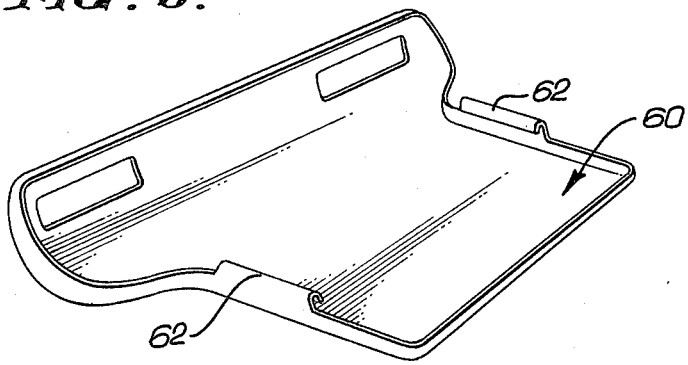
FIGS. 6, 7 and 8 are perspective views showing still other boot embodiments with different attachment means.

FIG. 6 shows a boot 60 having hooks 62 on its end or side walls for engagement with a base, not shown.

Figure 7:
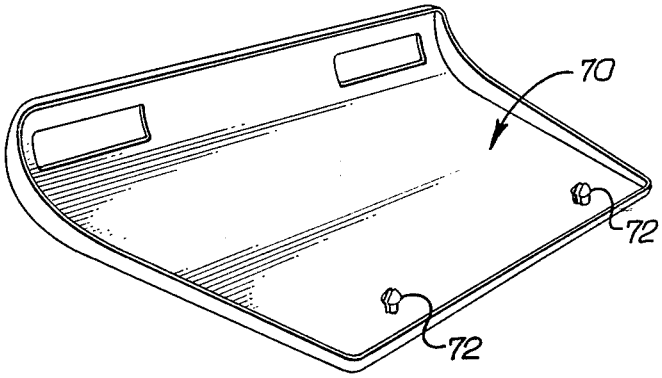

In FIG. 7 is a boot 70 having flexible plastic split pins 72 for insertion into attachment holes in a base, not shown.

Figure 8:
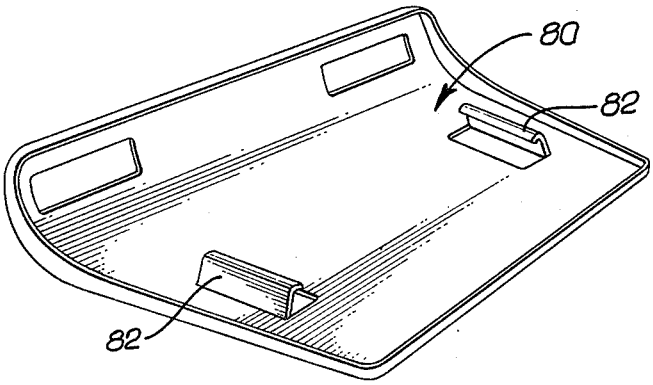

FIG. 8 shows a boot 80 having flexible plastic attachment tabs in intermediate areas, such tabs being engageable with suitable complementary portions of a trimmer base, not shown.

Another possibility is to attach a boot of the invention to a trimmer base with double faced tape.

Although exemplary embodiments of the invention have been disclosed for illustrative purposes, it will be understood that various changes, modifications and substitutions may be incorporated in such embodiments without departing from the invention as hereinafter claimed.

We claim:

1. A boot for a floor covering trimmer having a base provided at the rear thereof with an upwardly extending handle and carrying at the front thereof at least one forwardly and downwardly extending blade, said boot being of a size and shape to completely cover the bottom of the base and having means for attachment to the base, said boot also having at the front thereof an opening for the blade, said boot having at the front, rear and ends thereof upstanding walls which engage the front, rear and ends of the base.

2. A boot as defined in claim 1 wherein said attachment means comprises attachment elements engageable with portions of the base.

3. A boot as defined in claim 1 wherein said attachment means includes front and rear hook means engageable with front and rear edges, respectively, of said trimmer.

4. A boot as defined in claim 1 wherein said attachment means includes hook means adjacent each end of said boot.

5. A boot as defined in claim 1 wherein said attachment means includes spaced split pins projecting upward from said boot for engagement with said trimmer base.

6. A boot for a floor covering trimmer having a base provided at the rear thereof with an upwardly extending handle and carrying at the front thereof at least one forwardly and downwardly extending blade, said boot being of a size and shape to completely cover the bottom of the base and having means for attachment to the base, said boot also having at the front thereof an opening for the blade, said trimmer front having a curve of a first radius and said boot having a curve of a second smaller radius, with said boot including ribs spacing said boot front from said trimmer front.

* * * * *